US007633509B2

(12) United States Patent
Li et al.

(10) Patent No.: US 7,633,509 B2
(45) Date of Patent: Dec. 15, 2009

(54) LIQUID CRYSTAL DISPLAY AND THE DRIVING METHOD THEREOF

(75) Inventors: Wang-Yang Li, Tainan County (TW); Ying-Hao Hsu, Tainan County (TW)

(73) Assignee: CHI MEI Optoelectronics Corp., Tainan Science-Based Industrial Park (TW)

( * ) Notice: Subject to any disclaimer, the term of this patent is extended or adjusted under 35 U.S.C. 154(b) by 0 days.

(21) Appl. No.: 12/289,068

(22) Filed: Oct. 20, 2008

(65) Prior Publication Data

US 2009/0058879 A1 Mar. 5, 2009

Related U.S. Application Data

(63) Continuation of application No. 11/077,204, filed on Mar. 11, 2005, now Pat. No. 7,439,985.

(30) Foreign Application Priority Data

Mar. 12, 2004 (TW) ..... 93106764 A

(51) Int. Cl.
*G09G 3/36* (2006.01)
*G09G 5/02* (2006.01)

(52) U.S. Cl. ..... 345/601; 345/88; 345/89; 345/600; 345/690

(58) Field of Classification Search ..... 345/55–100, 345/204–214, 600–602, 690–697
See application file for complete search history.

(56) References Cited

U.S. PATENT DOCUMENTS

| | | | | |
|---|---|---|---|---|
| 6,008,786 | A | 12/1999 | Kimura et al. | |
| 6,856,306 | B2 * | 2/2005 | Ito | 345/89 |
| 7,439,985 | B2 * | 10/2008 | Li et al. | 345/600 |
| 2004/0075674 | A1 | 4/2004 | Bu | |

FOREIGN PATENT DOCUMENTS

| | | |
|---|---|---|
| JP | 02-193188 | 7/1990 |

* cited by examiner

*Primary Examiner*—David L Lewis
(74) *Attorney, Agent, or Firm*—Rabin & Berdo, P.C.

(57) ABSTRACT

A liquid crystal display (LCD) including an LCD panel and a driving unit is provided. The LCD panel has a red pixel, a green pixel, and a blue pixel. The driving unit is applied for receiving a red data signal, a green data signal, and a blue data signal, and outputting a red voltage signal, a green voltage signal, and a blue voltage signal for driving the red pixel, the green pixel, and the blue pixel respectively. When the red data signal, the green data signal, and the blue data signal all correspond to a specific gray level, the pixel luminance of the blue pixel is lower than the pixel luminance of the red pixel as well as the pixel luminance of the green pixel.

14 Claims, 5 Drawing Sheets

LIQUID CRYSTAL DISPLAY AND THE DRIVING METHOD THEREOF

This application is a continual application of co-pending application Ser. No. 11/077,204, filed on Mar. 11, 2005, and claims the benefit of Taiwan application Serial No. 93106764, filed Mar. 12, 2004, the subject matter of which is incorporated herein by reference.

BACKGROUND OF THE INVENTION

1. Field of the Invention

The invention relates in general to a liquid crystal display (LCD) and the driving method thereof, and more particularly to an LCD and the driving method thereof which reduce color difference by adjusting the corresponding red (R), green (G) and the blue (B) Gamma Curves of the LCD.

2. Description of the Related Art

Due to the features of low radiation, slimness and compactness, LCD has gained a wide popularity. Referring to FIG. 1, a partial circuit diagram of a conventional LCD is shown. LCD 10 at least comprises a data driver 12 and an LCD panel 14. The data driver 12 is for receiving an original red data signal SR0, an original green data signal SG0 and an original blue data signal SB0 outputted from a TV or computer and correspondingly outputting a red voltage signal VR, a green voltage signal VG and a blue voltage signal VB to the LCD panel 14. The LCD panel 14 respectively drives a red pixel, a green pixel and a blue pixel of the LCD panel 14 to display a corresponding frame according to the red voltage signal VR, the green voltage signal VG and the blue voltage signal VB received.

Referring to FIG. 2, a relationship curve between gray level and pixel luminance when a conventional multi-domain vertical alignment (MVA) LCD is viewed from the front is shown, wherein pixel luminance=Y (to-be-measured gray level)/Y (luminance maximum gray level, 255 for instance)× 100%, Y refers to luminance. When the original data signal corresponds to different gray levels, the data driver 12 will generate different the voltage value of the voltage signal accordingly, so the pixel will have different pixel luminance. The correspondence relationship between the gray level and pixel luminance of the red pixel forms a red Gamma Curve GC (R); the correspondence relationship between the gray level and pixel luminance of the green pixel forms a green Gamma Curve GC (G); while the correspondence relationship between the gray level and pixel luminance of the blue pixel forms a blue Gamma Curve GC (B). No overlapping occurs among the red Gamma Curve GC (R), the green Gamma Curve GC (G) and the blue Gamma Curve GC (B). Moreover, when the red pixel, the green pixel and the blue pixel all correspond to the same gray level, i.e., specific gray level GL1, the pixel luminance LB of the blue pixel viewed from the front is higher than the pixel luminance LG of the green pixel viewed from the front, while the pixel luminance LG of the green pixel viewed from the front is higher than the pixel luminance of the red pixel the LR viewed from the front.

Referring to FIG. 3, a relationship curve between gray level and pixel luminance when a conventional MVA LCD is viewed in a squint mode is shown. Let the maximum gray level of the LCD 14 be 255. When viewing the conventional LCD 14 in a squint mode within a gray level range of 50 to 150, the blue Gamma Curve viewed in a squint mode GC' (B) leads to a maximum difference between the pixel luminance viewed from the front and viewed in a squint mode. For a particular gray level GL1 within the gray level range of 50 to 150, the pixel luminance viewed in a squint mode of the red pixel, the green pixel and blue pixel are LR', LG' and LB' respectively.

Since a large difference exists between the Gamma Curve obtained when the LCD is viewed from the front and when the LCD is viewed in a squint mode, the ratio of LR', LG' and LB' (LR':LG':LB') when the pixel luminance viewed in a squint mode, is different from the ratio of LR, LG and LB (LR:LG:LB) when the pixel luminance viewed from the front. Therefore, when a user views a conventional LCD from the front or in a squint mode, the observed color is different leading to color difference. How to reduce color difference is therefore an essential factor to enhance the display quality of an LCD.

SUMMARY OF THE INVENTION

It is therefore an object of the invention to provide an LCD and the driving method thereof. By changing the blue Gamma Curve, the green Gamma Curve and the red Gamma Curve to obtain a blue Gamma Curve lower than the red Gamma Curve and the green Gamma Curve, the color difference of LCD is reduced and the LCD's display quality is improved.

According to an object of the invention, an LCD comprising an LCD panel and a driving unit is provided. The LCD panel comprises a red pixel, a green pixel and a blue pixel. The driving unit is for receiving a red data signal, a green data signal and a blue data signal and outputting a red voltage signal, a green voltage signal and a blue voltage signal to drive the red pixel, the green pixel and the blue pixel respectively. When the red data signal, the green data signal and the blue data signal all correspond to a specific gray level, the pixel luminance of the blue pixel is lower than the pixel luminance of red pixel as well as the pixel luminance of the green pixel.

According to another object of the invention, a driving method of LCD is provided. The LCD comprises an LCD panel and a driving unit, wherein the LCD panel comprises a red pixel, a green pixel and a blue pixel. The driving method according to the invention comprises the step of receiving a red data signal, a green signal and a blue data signal and outputting a red voltage signal, a green voltage signal and a blue voltage signal by the driving unit for driving the red pixel, the green pixel and the blue pixel respectively, wherein when the red data signal, the green data signal and the blue data signal all correspond to a specific gray level, the pixel luminance of the blue pixel is lower than the pixel luminance of the red pixel as well as the pixel luminance of the green pixel.

Other objects, features, and advantages of the invention will become apparent from the following detailed description of the preferred but non-limiting embodiments. The following description is made with reference to the accompanying drawings.

DETAILED DESCRIPTION OF THE INVENTION

The blue Gamma Curve used in the LCD and the driving method thereof according to the invention is lower than the red Gamma Curve and the green Gamma Curve so as to achieve the object of reducing the LCD's color difference and enhancing the LCD's display quality.

Figure 4:
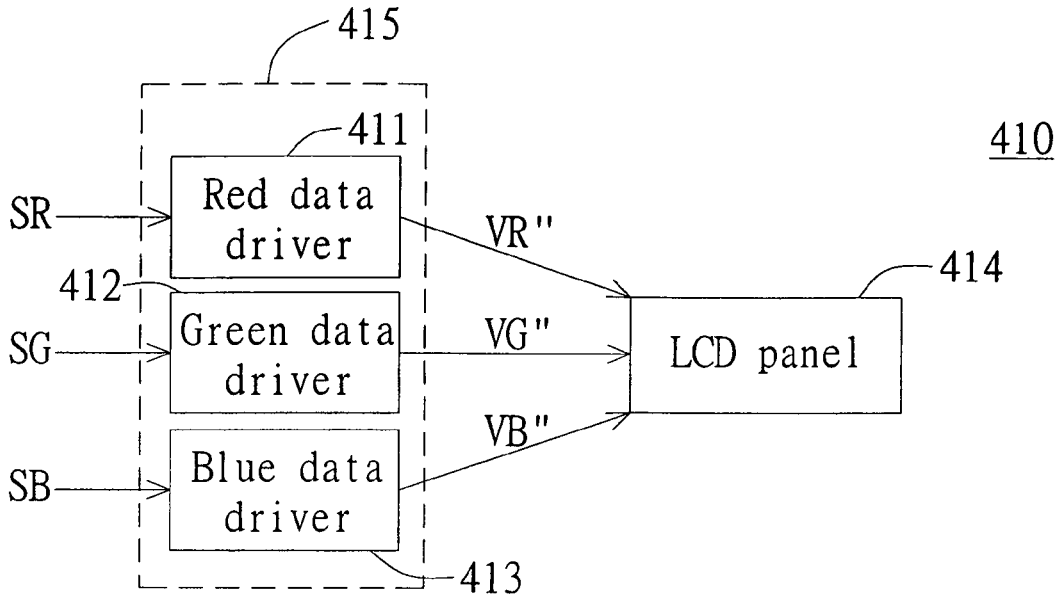
FIG. 4 is a diagram of the LCD according to preferred embodiment two of the invention.

Referring to FIG. 4, a diagram of the LCD according to preferred embodiment two of the invention is shown. LCD 410 according to the invention comprises an LCD panel 414 and a driving unit 415. The LCD panel 414 comprises a red pixel, a green pixel and a blue pixel (not shown here). The driving unit 415 comprises a red data driver 411, a green data driver 412 and a blue data driver 413 for receiving a red data signal SR, a green data signal SG and a blue data signal SB respectively, and outputting a red voltage signal VR", a green voltage signal VG" and a blue voltage signal VB" respectively to drive a red pixel, a green pixel and a blue pixel respectively.

Figure 5:
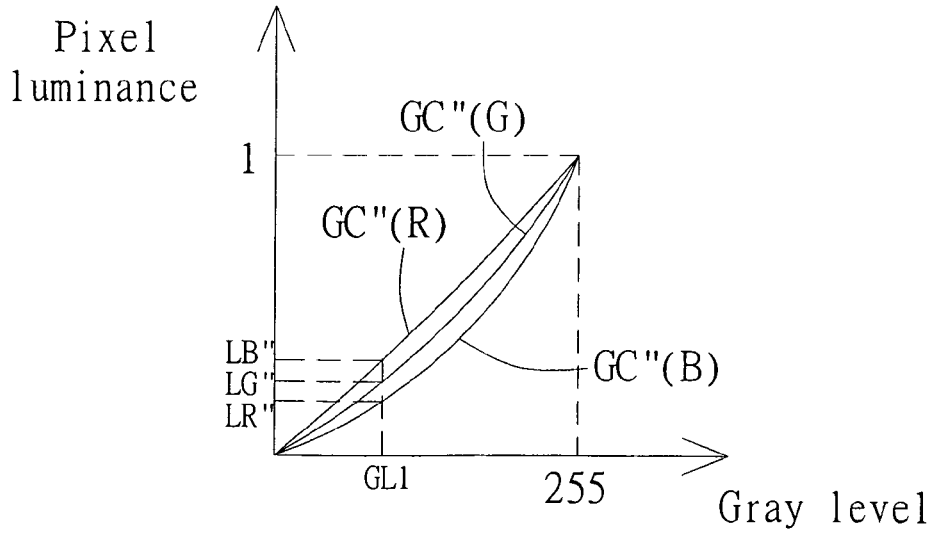
FIG. 5 is a relationship curve between gray level and pixel luminance when the LCD 410 according to the invention is viewed from the front.

Referring to FIG. 5, a relationship curve between gray level and pixel luminance when the LCD 410 according to the invention is viewed from the front is shown. When the red data signal SR is of different gray levels, the corresponding pixel luminance of the red pixel when viewed from the front will be different. Similarly, when the green data signal SG is of different gray levels, the corresponding pixel luminance of the green pixel when viewed from the front will be different; when the blue data signal SB is of different gray levels, the corresponding pixel luminance of the blue pixel when viewed from the front will be different as well. When the red data signal SR, the green data signal SG and the blue data signal SB received by the driving unit 415 all correspond to the specific gray level GL1, the obtained pixel luminance of the blue pixel LB" viewed from the front is lower than the pixel luminance of the red pixel the LR" viewed from the front as well as the pixel luminance of the green pixel LG" viewed from the front.

Let the maximum gray level of the LCD be 255. When the gray level is within the range of 50 to 150, the color difference between the blue Gamma Curve of a conventional LCD viewed in a squint mode and that viewed from the front is larger than the color difference between a Gamma Curve of other colors (the green Gamma Curve and the red Gamma Curve for instance) of a conventional LCD viewed in a squint mode and that viewed from the front, so the blue Gamma Curve has the largest color difference. The invention preferably and at least let the pixel luminance LB" of the blue pixel viewed from the front corresponding to the particular gray level GL1 within the gray level range of 50 to 150 be lower than the pixel luminance LR" of the red pixel the viewed from the front as well as the pixel luminance LG" of the green pixel viewed from the front so as to reduce the difference in pixel luminance when various pixels are viewed in a squint mode. That is to say, in order to achieve a minimum pixel luminance LB" of the blue pixel, the corresponding particular gray level GL1 is preferably within the range of 0.2 to 0.6 times of the maximum gray level. According to the invention, the pixel luminance LB" of the blue pixel corresponding to all gray levels can be designed to be lower than the pixel luminance LR" of the red pixel as well as the pixel luminance LG" of the green pixel. Preferably, the pixel luminance LR" of the red pixel is higher than the pixel luminance LG" of the green pixel.

To achieve the object of having the pixel luminance LB" of the blue pixel viewed from the front be lower than the pixel luminance LR" of the red pixel viewed from the front as well as the pixel luminance LG" of the green pixel viewed from the front, the invention is exemplified by means of preferred embodiment one to preferred embodiment three.

PREFERRED EMBODIMENT ONE

Figure 6:
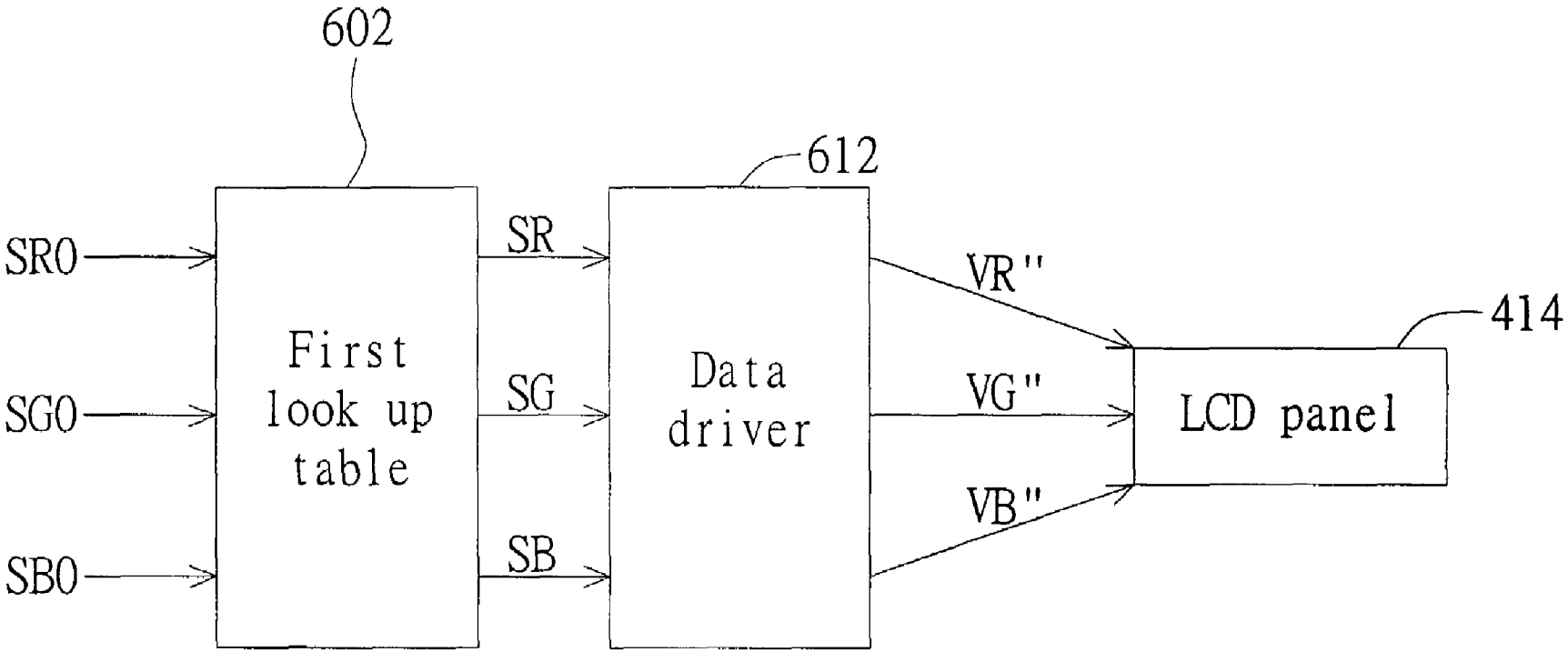
FIG. 6 is a diagram of the LCD according to preferred embodiment one of the invention.

Referring to FIG. 6, a diagram of the LCD according to preferred embodiment one of the invention is shown. The present preferred embodiment uses a first look up table 602 to convert an original blue data signal SB0 into a blue data signal SB, so that the relationship between the gray level and pixel luminance of the blue data signal SB complies with the blue Gamma Curve shown in FIG. 5 and that the above objects can be achieved. For example, let the original red data signal SR0, the original green data signal SG0 and the original blue data signal SB0 all correspond to the particular gray level GL1 equal to 50 and are inputted to first look up table 602 for conversion, the gray level of the converted blue data signal SB is 48 for instance. So, the converted gray level of the pixel luminance LB" of the blue pixel viewed from the front is lower than the actual gray level of the pixel luminance LR" of the red pixel viewed from the front as well as the actual gray level of the pixel luminance LG" of the green pixel viewed from the front (the original gray level is equal to 50 while the converted gray level is equal to 48).

If a higher precision is desired, the data bites of the converted blue data signal SB can be larger than that of the original blue data signal SB0. That is to say, if the original blue data signal SB0 is of 8 bites, the converted blue data signal SB can be of 10 bites wherein the last two bites are used for recording the decimal part.

Figure 1:
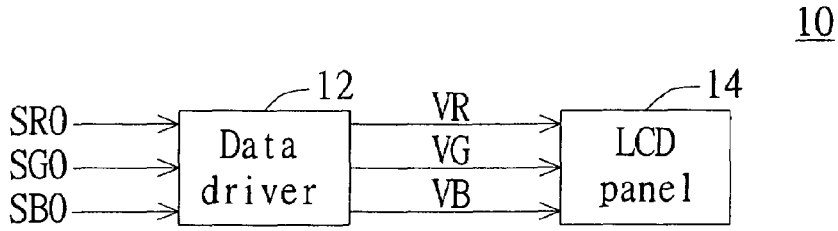
FIG. 1(PRIOR ART)
FIG. 1 is a partial circuit diagram of a conventional LCD.

In preferred embodiment one, the red data driver, the green data driver and the blue data driver have the same correspondence relationship between the gray level of the data signal received and the voltage signal outputted, so the red data driver, the green data driver and the blue data driver can be implemented by the same data driver 612 as shown in FIG. 6. The red data signal SR, the green data signal SG and the red data signal SR are converted and sequentially inputted to the data driver 612 for further processing. So, the present preferred embodiment can be implemented by adding a first look up table 602 to the structure of the LCD according to FIG. 1. The present preferred embodiment further has the advantages of low cost and easy implementation.

PREFERRED EMBODIMENT TWO

The present preferred embodiment achieves the object of the invention by means of various correspondence relationships between gray level and voltage signal which are different for the red data driver 411, the green data driver 412 and the blue data driver 413. In the present preferred embodiment, an original red data signal SR0, an original green data signal SG0 and an original blue data signal SB0 are respectively inputted into the red data driver 411, the green data driver 412 and the blue data driver 413 as a red data signal SR, a green data signal SG and a blue data signal SB.

Refer to FIG. 4. For example, when the red data signal SR, the green data signal SG and the blue data signal SB all correspond to a particular gray level GL1 equal to 50, the voltage value of the blue voltage signal VB" outputted by the blue data driver 413 is different from the voltage value of the red voltage signal VR" outputted by red data driver 411, so that the pixel luminance LB" of the blue pixel viewed from the front will be lower than the pixel luminance LR" of the red pixel viewed from the front. Similarly, the voltage value of the blue voltage signal VB" outputted by the blue data driver 413 is different from the voltage value of the green voltage signal VG" outputted by the green data driver 412, so that the pixel luminance LB" of the blue pixel viewed from the front will be lower than the pixel luminance of the green pixel LG" viewed from the front. Consequently, the object of the invention can be achieved.

Furthermore, the present preferred embodiment achieves the above objects by adjusting the relationship between a group of gray levels (for instance, gray level 0, 31, 63, 95, 127, 159, 191, 223, and 255) and voltages. For a particular group of gray level, the voltage value of the blue voltage signal VB" is different from the voltage value of the red voltage signal VR", while the voltage value of the blue voltage signal VB" is also different from the voltage value of the green voltage signal VG". The voltage values corresponding to other gray levels can be obtained via interpolation method.

PREFERRED EMBODIMENT THREE

Preferred embodiment three according to the invention achieves the object of the invention and enhances the luminance of the panel by having the maximum operating voltage of the red pixel, of the green pixel and of the blue pixel to be different from one another.

Figure 2:
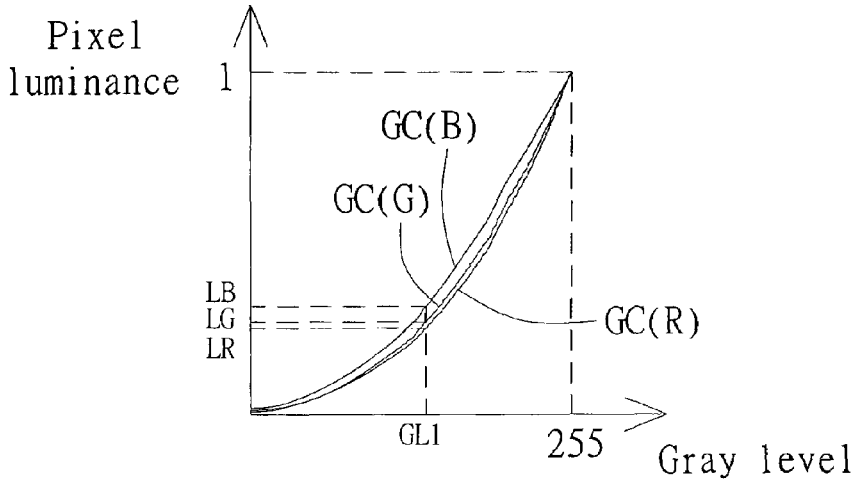
FIG. 2(PRIOR ART)
FIG. 2 is a relationship curve between gray level and pixel luminance when a conventional LCD is viewed from the front.
Figure 3:
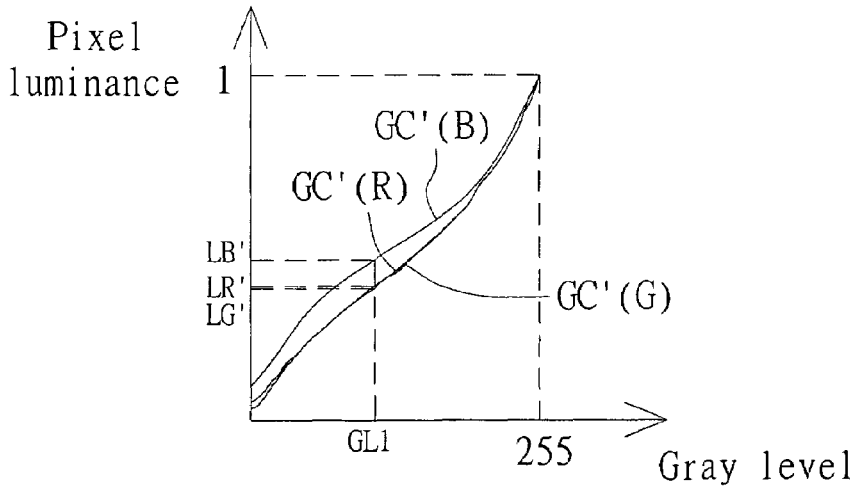
FIG. 3(PRIOR ART)
FIG. 3 is a relationship curve between gray level and pixel luminance when a conventional LCD is viewed in a squint mode.
Figure 7:
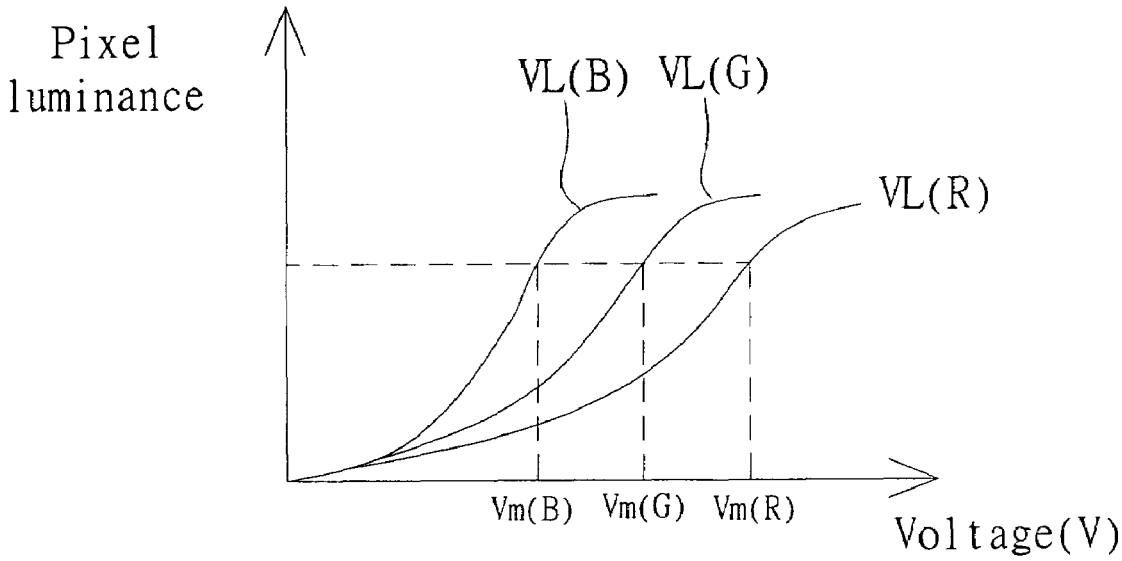
FIG. 7 is a relationship curve between the voltage for driving the pixel and pixel luminance of the LCD according to preferred embodiment three of the invention.

Referring to FIG. 7, a relationship curve between the voltage for driving the pixel and pixel luminance of the LCD according to preferred embodiment three of the invention is shown. The relationship between the voltage and pixel luminance of the red pixel is denoted as VL (R), the relationship between the voltage and pixel luminance of the green pixel is denoted as VL (G), while the relationship between the voltage and pixel luminance of the blue pixel is denoted as VL (B). When the red data signal SR, the green data signal SG and the blue data signal SB all correspond to a maximum gray level, the red voltage signal VR" comprises a red maximum operating voltage Vm (R), the green voltage signal VG" comprises a green maximum operating voltage Vm (G), and the blue voltage signal VB" comprises a blue maximum operating voltage Vm (B). The operating voltages Vm (R), Vm (G) and Vm (B) which make the corresponding white color temperature of the LCD panel 414 is selected to be the target values. The prior art uses the maximum operating voltages of the same group to drive the red pixel, the green pixel, and the blue pixel and generates various pixel luminance according to different gray levels. The obtained Gamma Curve when the LCD is viewed from the front is different from that obtained when viewed in a squint mode, so the color difference according to FIG. 2 occurs when the Gamma Curve of the LCD viewed from the front differs widely from that when viewed in a squint mode.

Figure 8:
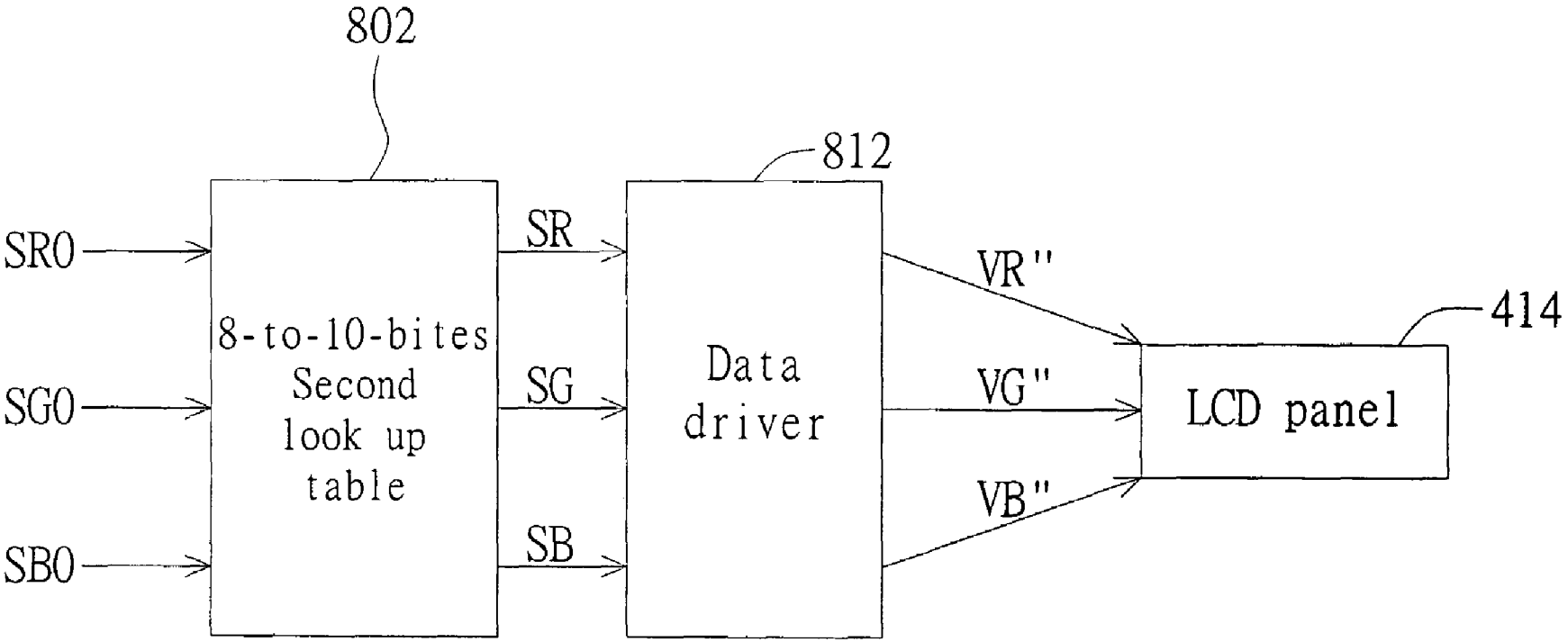
FIG. 8 is a schematic diagram of the LCD according to preferred embodiment three of the invention.

Referring to FIG. 8, a schematic diagram of the LCD according to preferred embodiment three of the invention is shown. The present preferred embodiment uses an 8-to-10-bites second look up table 802 to convert an original blue data signal SB0 of 8 bites to a blue data signal SB of 10 bites. The gray level of the blue data signal SB corresponding to the original blue data signal SB0 of the maximum gray level is lower than the gray level of the red data signal SR corresponding to the original red data signal SR0 of the maximum gray level as well as the gray level of the green data signal SG corresponding to the original green data signal SG0 of the maximum gray level. In the present preferred embodiment, the red data driver, the green data driver and the blue data driver have the same correspondence relationship between the gray level of the data signal received and the voltage signal outputted, so the red data driver, the green data driver and the blue data driver can be implemented by the same data driver 812 as shown in FIG. 8. So, the present preferred embodiment can be implemented by adding a first look up table 802 to the structure of the LCD according to FIG. 1. The present preferred embodiment further has the advantages of low cost and easy implementation.

For example, when the gray levels of the original blue data signal SB0, the original green data signal SG0 and the original red data signal SR0 all equal to 255, the maximum gray level, the gray levels of the blue data signal SB, the green data signal SG and the red data signal SR outputted by the second look up table 802 will be equal to 800, 900 and 1023 respectively. Given that the correspondence relationships between the gray level and the voltage value of the voltage signal for the red data driver 411, the green data driver 412 and the blue data driver 413 are all the same, the voltage value of the blue voltage signal VB" corresponding to the blue data signal SB of the gray level 800, i.e., the blue maximum operating voltage Vm (B), is lower than the voltage value of the red voltage signal VR" corresponding to the red data signal SR of the gray level 1023, i.e., the red maximum operating voltage Vm (R) as well as the voltage value of the green voltage signal VG" corresponding to the green data signal SG of the gray level 900, i.e., the green maximum operating voltage Vm (G).

The present preferred embodiment uses the second look up table to have the maximum gray level of the converted blue data signal be lower than the maximum gray level of the red data signal as well as that of the green data signals. That is to say, in order to achieve the object of the invention, the blue maximum operating voltage Vm (B) is respectively lower than the red maximum operating voltage Vm (R) and the green maximum operating voltage Vm (G).

The design flowchart of the second look up table according to preferred embodiment three of the invention is disclosed below. Firstly, refer to FIG. 7 to select the operating voltages Vm (R), Vm (G) and Vm (B) which make the corresponding white color temperature of the LCD panel 414 to be the target values. Preferably, the blue maximum operating voltage Vm (B) is the minimum of the red maximum operating voltage Vm (R), the green maximum operating voltage Vm (G) and the blue maximum operating voltage Vm (B). For example, the blue maximum operating voltage Vm (B), the green maximum operating voltage Vm (G) and the red maximum operating voltage Vm (R) 可 are respectively equal to 5V, 6.5V and 8V.

Next, the relationship between the original gray level and the voltage can be obtained according to the relationship curve between the voltage and pixel luminance of the maximum operating voltages Vm (R), Vm (G), Vm (B) respectively shown in FIG. 7 and the relationship curve between the original gray level and pixel luminance shown in FIG. 5. That is to obtain the operating voltage value of the red, the green and the blue pixels corresponding to each of the original gray levels. After that, according to the correspondence relationship between the converted gray level and the voltage value of the 10-bites data driver, obtain the converted gray level corresponding to the operating voltage value so as to obtain the relationship between the original gray level and the converted gray level and record the relationship in the second look up table 802. Therefore, after the original red data signal SR0, the original green data signal SG0 and the original blue data signal SB0 are inputted into the second look up table 802, the red data signal SR, the green data signal SG and the blue data signal SB will be obtained. The red data driver 411, the green data driver 412 and the blue data driver 413 respectively receives the red data signal SR, the green data signal SG and the blue data signal SB to generate the voltage value of the red voltage signal VR", the voltage value of the green voltage signal VG" and the voltage value of the blue voltage signal VB" to drive the red pixel, the green pixel and the blue pixel respectively, Therefore, the present preferred embodiment uses different driving voltages to drive the pixels of various colors so as to achieve a more efficient pixel luminance.

In preferred embodiment two disclosed above, the maximum operating voltages of the red pixel, the green pixel and the blue pixel can be different as well.

Preferably, the LCD of the invention is a vertical alignment mode (VA mode) LCD. By having the blue Gamma Curve be lower than the red Gamma Curve and the green Gamma Curve when the LCD is viewed from the front, the blue Gamma Curve, the red Gamma Curve and the green Gamma Curve when the LCD is viewed in a squint mode become very close to each other. Therefore, when viewing the LCD from the front, the ratio among the pixel luminance of the red, the green and the blue pixels viewed from the front will be closer than the ratio among the pixel luminance of the red, the green and the blue pixels viewed in a squint mode. The observed colors when viewing the LCD of the invention from the front are very close to that when viewing the LCD of the invention in a squint mode, so that the color difference can be reduced. Therefore, the invention effectively corrects color difference and improves display quality of an LCD.

While the invention has been described by way of example and in terms of a preferred embodiment, it is to be understood that the invention is not limited thereto. On the contrary, it is intended to cover various modifications and similar arrangements and procedures, and the scope of the appended claims therefore should be accorded the broadest interpretation so as to encompass all such modifications and similar arrangements and procedures.

What is claimed is:

1. A liquid crystal display (LCD), comprising:

an LCD panel comprising a red pixel, a green pixel and a blue pixel;

a gray level converting unit, for receiving and converting an original red data signal, an original green data signal and an original blue data signal into a red data signal, a green data signal and a blue data signal, wherein when the original red data signal, the original green data signal and the original blue data signal all correspond to a specific gray level, the value of the blue data signal is lower than the value of the red data signal as well as the value of the green data signal; and a driving unit applied for receiving the red data signal, the green data signal and the blue data signal and outputting a red voltage signal, a green voltage signal and a blue voltage signal to drive the red pixel, the green pixel and the blue pixel respectively;

wherein when the original red data signal, the original green data signal and the original blue data signal all correspond to the specific gray level, the difference of pixel luminance between the blue pixel corresponding to the blue data signal and the red pixel corresponding to the red data signal is lower than the difference of pixel luminance between the blue pixel corresponding to the original blue data signal and the red pixel corresponding to the original data signal, and the difference of pixel luminance between the blue pixel corresponding to the blue data signal and the green pixel corresponding to the green data signal is lower than the difference of pixel luminance between the blue pixel corresponding to the original blue data signal and the green pixel corresponding to the original green data signal.

2. The LCD according to claim 1, wherein the LCD comprises a maximum gray level, the specific gray level is approximately within the range of 0.2 to 0.6 times of the maximum gray level.

3. The LCD according to claim 1, wherein the LCD comprises a maximum gray level, the specific gray level is lower than or equal to the maximum gray level.

4. The LCD according to claim 3, wherein when the red data signal, the green data signal and the blue data signal all correspond to the maximum gray level, the red voltage signal comprises a red maximum operating voltage, the green voltage signal comprises a green maximum operating voltage, and the blue voltage signal comprises a blue maximum operating voltage, wherein the blue maximum operating voltage is the minimum of the red maximum operating voltage, the green maximum operating voltage and the blue maximum operating voltage.

5. The LCD according to claim 1, wherein when the red data signal, the green data signal and the blue data signal all correspond to the specific gray level, and the pixel luminance of the red pixel is higher than the pixel luminance of the green pixel.

6. The LCD according to claim 1, wherein the LCD is a vertical alignment mode (VA mode) LCD.

7. The LCD according to claim 1, wherein when the red data signal, the green data signal and the blue data signal all correspond to the specific gray level, the pixel luminance of the blue pixel viewed from the front is lower than the pixel luminance of the red pixel viewed from the front as well as the pixel luminance of the green pixel viewed from the front.

8. A driving method of an LCD comprising an LCD panel and a driving unit, wherein the LCD panel comprises a red pixel, a green pixel and a blue pixel, the driving method comprising steps of:

receiving and converting an original red data signal, an original green data signal, and an original blue data signal into a red data signal, a green data signal and a blue data signal, wherein when the original red data signal, the original green data signal and the original blue data signal all correspond to a specific gray level, the value of the blue data signal is lower than the value of the red data signal as well as the value of the green data signal; and receiving the red data signal, the green signal and the blue data signal and outputting a red voltage signal, a green voltage signal and a blue voltage signal by the driving unit for driving the red pixel, the green pixel and the blue pixel respectively;

wherein when the original red data signal, the original green data signal and the original blue data signal all correspond to the specific gray level, the difference of pixel luminance between the blue pixel corresponding to the blue data signal and the red pixel corresponding to the red data signal is lower than the difference of pixel luminance between the blue pixel corresponding to the original blue data signal and the red pixel corresponding to the original data signal, and the difference of pixel luminance between the blue pixel corresponding to the blue data signal and the green pixel corresponding to the green data signal is lower than the difference of pixel luminance between the blue pixel corresponding to the original blue data signal and the green pixel corresponding to the original green data signal.

9. The driving method according to claim 8, wherein the LCD comprises a maximum gray level, the specific gray level is approximately within the range of 0.2 to 0.6 times of the maximum gray level.

10. The driving method according to claim 8, wherein the LCD comprises a maximum gray level, the specific gray level is lower than or equal to the maximum gray level.

11. The driving method according to claim 10, wherein when the red data signal, the green data signal and the blue data signal all correspond to the maximum gray level, the red voltage signal comprises a red maximum operating voltage, the green voltage signal comprises a green maximum operating voltage, and the blue voltage signal comprises a blue maximum operating voltage, wherein the blue maximum operating voltage is the red maximum operating voltage, the green maximum operating voltage and the blue maximum operating voltage.

12. The driving method according to claim 8, wherein when the red data signal, the green data signal and the blue data signal all correspond to the specific gray level, and the pixel luminance of the red pixel is higher than the pixel luminance of the green pixel.

13. The driving method according to claim 8, wherein the LCD is a vertical alignment mode (VA mode) LCD.

14. The driving method according to claim 8, wherein when the red data signal, the green data signal and the blue data signal all correspond to the specific gray level, the pixel luminance of the blue pixel viewed from the front is lower than the pixel luminance of the red pixel viewed from the front as well as the pixel luminance of the green pixel viewed from the front.

* * * * *